US007744236B2

(12) United States Patent
Hsu et al.

(10) Patent No.: US 7,744,236 B2
(45) Date of Patent: Jun. 29, 2010

(54) UNDERWATER LAMP

(75) Inventors: Hung-Kuang Hsu, Miao-Li Hsien (TW); Chun-Wei Wang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 12/170,771

(22) Filed: Jul. 10, 2008

(65) Prior Publication Data

US 2009/0154164 A1 Jun. 18, 2009

(30) Foreign Application Priority Data

Dec. 18, 2007 (CN) ..... 2007 1 0203159

(51) Int. Cl.
*F21V 33/00* (2006.01)

(52) U.S. Cl. ..... 362/101; 362/267; 362/800

(58) Field of Classification Search ..... 362/101, 362/800, 294, 373
See application file for complete search history.

(56) References Cited

U.S. PATENT DOCUMENTS 6,679,352 B2 * 1/2004 Gillespie ..... 184/15.1
6,971,760 B2 12/2005 Archer et al.
7,244,037 B2 * 7/2007 Koren ..... 362/101
7,401,935 B2 * 7/2008 VanderSchuit ..... 362/101
7,510,292 B2 * 3/2009 Ichikawa ..... 362/101

OTHER PUBLICATIONS

Michael S. Shur et al., Solid-State Lighting: Toward Superior Illumination, Proceedings of the IEEE, 1691-1703, vol. 93, No. 10, Oct. 2005.

* cited by examiner

*Primary Examiner*—Anabel M Ton
(74) *Attorney, Agent, or Firm*—Andrew C. Cheng

(57) ABSTRACT

An underwater lamp includes a cylindrical shaped shell with two opposite ends being open, a lens being received at one of the two opposite ends of the shell, and a sink base attaching to the other one of the two opposite ends of the shell. An interior space is defined among the shell, the sink base, and the lens. A light generating element for emitting light is received in the interior space and thermally attached to the sink base. The light generating element has an emitting surface facing the lens. At least one opening is defined in the lamp for fluid flowing into the interior space.

19 Claims, 3 Drawing Sheets

UNDERWATER LAMP

BACKGROUND

1. Field of the Invention

The present invention relates to an underwater lamp incorporating a solid state lighting element as a light source.

2. Description of Related Art

In recent years, light emitting diodes (LEDs) have been widely used as a light source in underwater applications such as swimming pools, water fountains, rearing ponds, and aquariums.

A typical underwater lamp includes a shell, a lens, and at least one LED. The lens couples to an opening of the shell to seal the shell. Thus the shell and the lens define a hermetic space for receiving the LED therein. The LED includes an LED die facing the lens and a packaging layer encapsulated the LED die. The packaging layer is usually made of transparent macromolecular materials, such as epoxy resin and silica gel. A refractive index of the packaging layer is about 1.5. However, the air between the packaging layer and the lens has a refractive index about 1.0. Snell's Law describes the relationship between the angles and the velocities of the waves. A critical angle is about 42 degree. In other words, the light with an angle of incidence smaller than 42 degrees can pass across the boundary to the space, whilst the light with an angle of incidence not smaller than 42 degrees generates total reflection at the boundary and then travels back to the packaging layer. Only a small portion of the light can pass through the packaging layer into space, and then travels through the lens to the outside. Thus, a utilization efficiency of the light of the LED is relatively low.

Therefore, an improved underwater lamp is desired which overcomes the above-described deficiencies.

SUMMARY

An underwater lamp includes a cylindrical shaped shell with two opposite ends being open, a lens being received at one of the two opposite ends of the shell, and a sink base attaching to the other one of the two opposite ends of the shell. An interior space is defined among the shell, the sink base, and the lens. A light generating element for emitting light is received in the interior space and thermally attached to the sink base. The light generating element has an emitting surface facing the lens. At least one opening is defined in the lamp for fluid flowing into the interior space.

Other advantages and novel features of the present invention will be drawn from the following detailed description of the exemplary embodiments of the present invention with attached drawings.

DETAILED DESCRIPTION OF THE EMBODIMENTS

Figure 1:
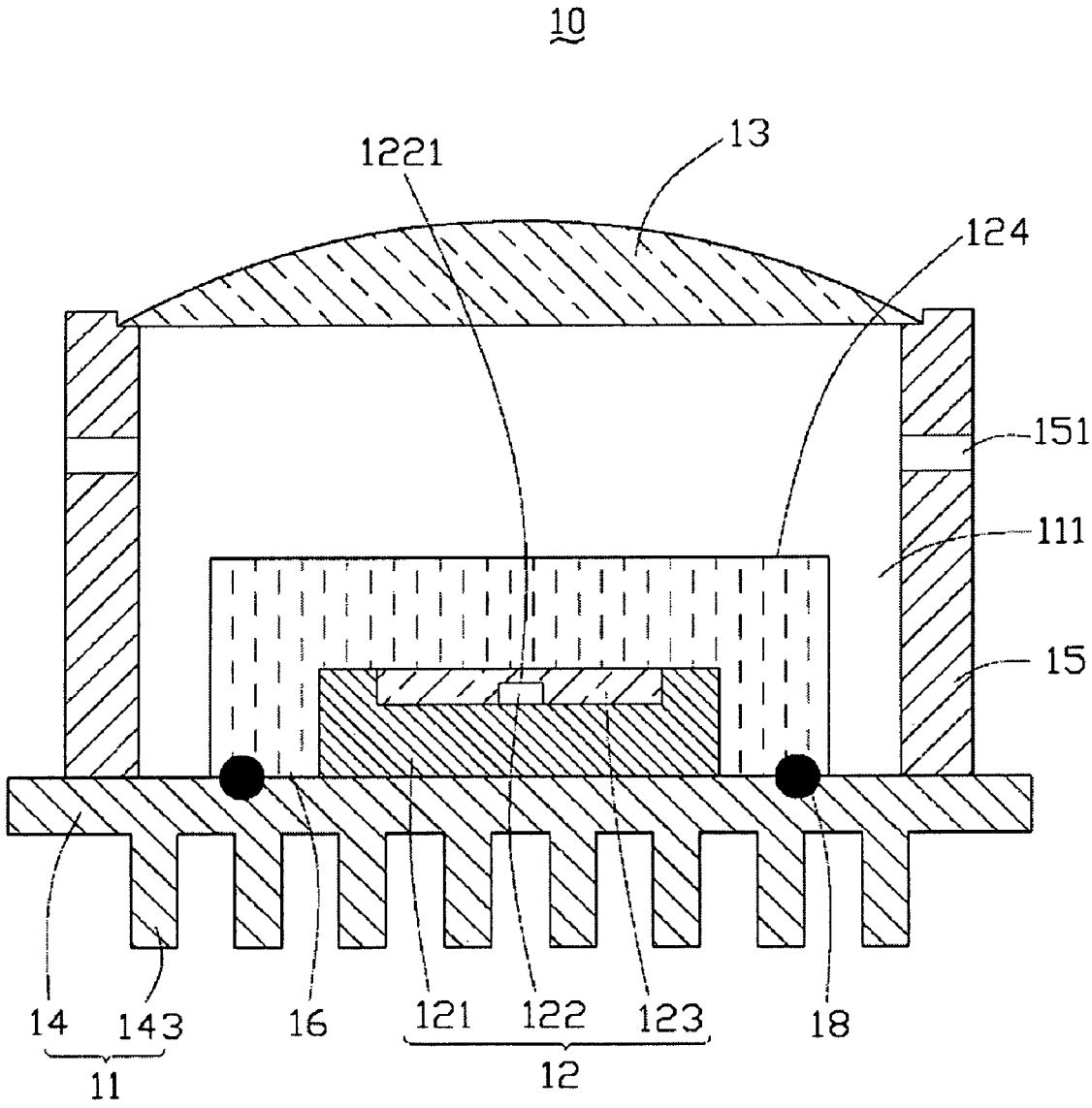
FIG. 1 is a cross-sectional view of one embodiment of an underwater lamp.

Referring to FIG. 1, an underwater lamp 10 includes a cylindrical shell 15, a light generating element 12, a divergent lens 13 and a sink 11.

The shell 15 includes an open top end (not labeled) and an open bottom end (not labeled) opposite the open top end. The sink 11 fixedly attaches to the bottom end of the shell 15 and forms a water-tight seal at the open bottom end of the shell 15. The sink 11 is configured for dissipating heat of the light generating element 12 and includes a sink base 14 and a plurality of fins 143 extending away from the sink base 14. The divergent lens 13 is received at the open top end of the shell 15. The shell 15, the sink 11, and the divergent lens 13 cooperatively define an interior space 111. In one embodiment, a pair of openings 151 are defined in the shell 15 to intercommunicate the exterior with the interior space 111 of the shell 15. It may be appreciated that the pair openings 151 can be defined in the lens 13 or defined in the sink base 14 and the quantity of the openings can vary according to design.

The light generating element 12 is received in the interior space 111 and fixedly attached to the sink base 14 forming a heat conduction path. In the illustrated embodiment, the light generating element 12 is a light emitting diode (LED). It may be appreciated that a quantity of the LED can be changed according to the need of light intensity. In other embodiments, the light generating element 12 can be other types of light generating devices, such as bulbs and cold cathode fluorescent lamps (CCFLs). The LED includes a substrate 121, an LED die 122, and a packaging layer 123. The substrate 121 has a planar-shaped bottom surface fixedly attached to the sink base 14 forming a heat conduction path such that the heat generated by the LED can be transferred through the sink base 14 to the plurality of fins 143 to dissipate the heat. A recess (not labeled) is defined in a top surface of the substrate 121. The LED die 122 is arranged in a central portion of the recess, and is electrically connected to the substrate 121. The LED die 122 has an emitting surface 1221 facing towards the divergent lens 13. The LED die 122, the divergent lens 13, and the shell 15 are preferably coaxial.

The packaging layer 123 is provided to encapsulate the LED die 122. The packaging layer 123 is made of transparent materials, such as epoxy and silicon. In the illustrated embodiment, a refractive index of the packaging layer 123 is about 1.5. A transparent waterproof layer 16 covers the LED. The waterproof layer 16 can be made of glass, acrylic, or polycarbonate. A refractive index of the packaging layer 123 should be approximately the same as the refractive index of the packaging layer 123, so that all of the light can pass across the packaging layer 123 and enter into the waterproof layer 16 with minimal reflection and refraction. The waterproof layer 16 forms a boundary 124 with the interior space 111. The waterproof layer 16 has a bottom end (not labeled) attached to the sink base 14, to encase the LED. In addition, a sealing ring 18 is positioned between the bottom end of the waterproof layer 16 and the sink base 14 of the sink 11 to form a water-tight seal around the LED.

Figure 2:
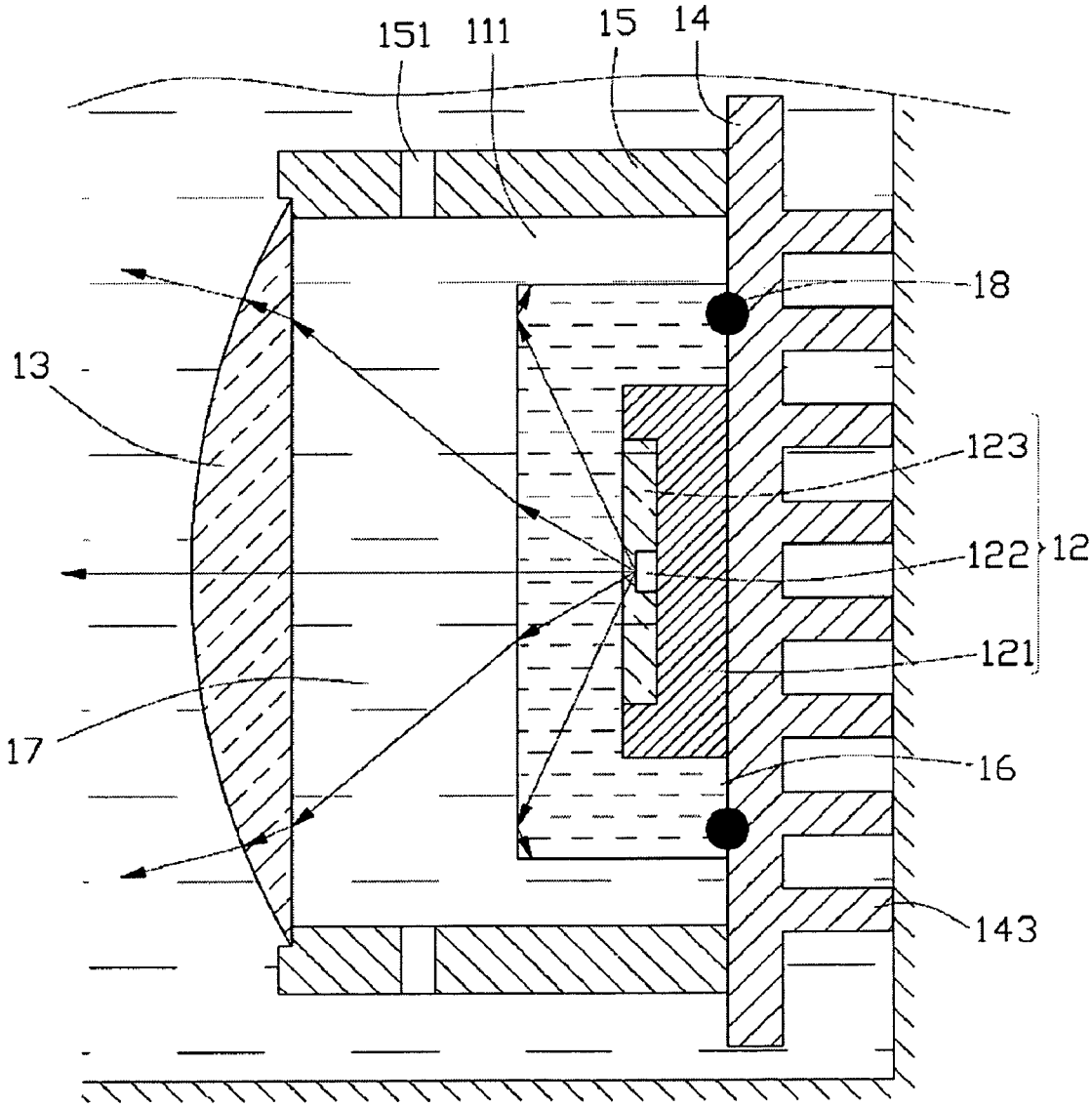
FIG. 2 is a cross-sectional view of the underwater lamp of FIG. 1 in use.

FIG. 2 shows the underwater lamp 10 in use underwater, such as in a swimming pool filled with water 17. In this embodiment, the underwater lamp 10 is arranged transversely. The water 17 flows into the interior space 111 through the openings 151 of the shell 15. The LED die 22 is shielded from the water 17 by the waterproof layer 16, the packaging layer 123, and the sealing ring 18. Light emitted from the LED passes across the packaging layer 123, the waterproof layer 16, the water 17, and then out through the divergent lens 13. A refractive index of water 17 is about 1.3. According to Snell's law, when light passes across the boundary 124 to the water 17, part of the light is reflected back towards the LED. Based on a refractive index of 1.5 for both the packaging layer 123 and the waterproof layer 16, the critical angle when light passes across the boundary 124 of the waterproof layer 16 to the water 17 is about 63 degrees, which is much larger than the critical angle when light passes across the boundary of the waterproof layer and the air. In other words, light rays with an angle of incidence smaller than 63 degree will pass across the packaging layer 123 and enter into the water 17. The light entering the water 17 passes through the divergent lens 13, illuminating the swimming pool. The utilization efficiency of the lamp 10 is improved because more light of the LED can pass through the underwater lamp 10 with water in the interior space 111 rather than air.

The heat of the LED is primarily transferred to the sink base 14 and conducted to the plurality of fins 143. The utilization efficiency is also improved because the water 17 can absorb the heat generated by the LED. Heat from the sink base 14 and the plurality of fins 143 is transferred to the water 17 by convection. In addition, the heat of the LED can be effectively dissipated by the water 17 because water 17 has a higher thermal conductivity than air, so the LED can be maintained at a relatively low working temperature. Thus, a luminous intensity of the LED is higher and the lifespan of the LED is significantly improved.

Figure 3:
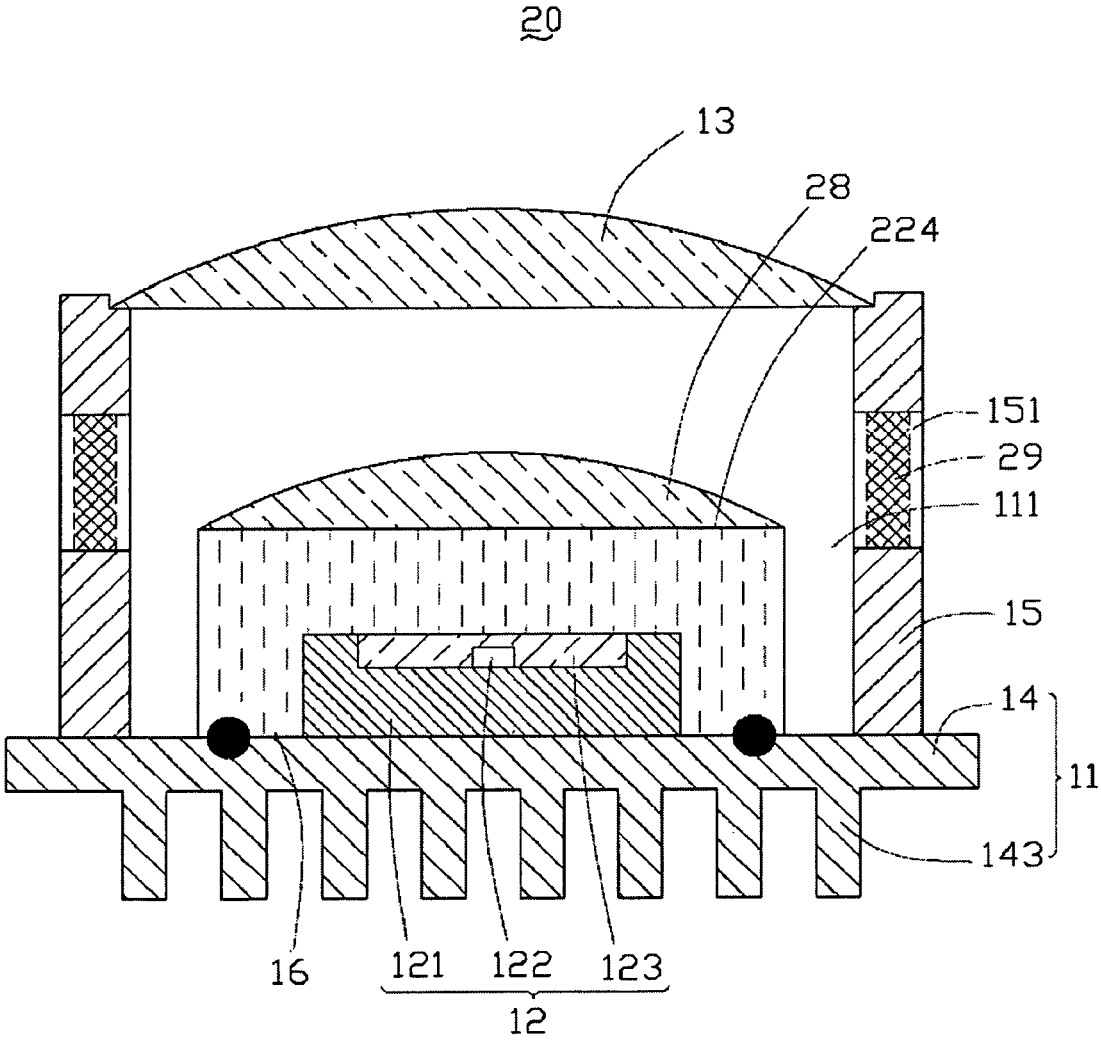
FIG. 3 is a cross-sectional view of another embodiment of the underwater lamp.

FIG. 3 is another embodiment of an underwater lamp 20. Here, a convergent lens 28 is positioned on the boundary 224 so that as light emitted from the LED die 122 passes through the convergent lens 28, the light is refracted and converged by the convergent lens 28. An angle of incidence of the light at the boundary of the convergent lens 28 and the water 17 is reduced. In other words, more light will have an angle of incidence smaller than the critical angle, allowing more light to pass across the convergent lens 28. In one embodiment, a filter 29 is arranged in each opening 151 of the shell 15 to keep pollutants from flowing into the interior space 111.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. An underwater lamp, comprising:

a light generating element for emitting light, the light generating element having a light emitting surface;

a shell;

a lens being received at one end of the shell, wherein the shell and the lens cooperatively define an interior space; the interior space receiving the light generating element therein; the lens facing the light emitting surface; and at least one opening being defined in one of the shell and the lens of the underwater lamp to intercommunicate the interior space with an exterior of the underwater lamp.

2. The underwater lamp of claim 1, further comprising a sink base attached to another end of the shell opposite to the lens, wherein the light generating element is fixedly attached to the sink base, forming a heat conduction path.

3. The underwater lamp of claim 2, further comprising a plurality of fins integrally formed with the sink base and extending away from the sink base.

4. The underwater lamp of claim 2, wherein the light generating element comprises at least one light emitting diode; the at least one light emitting diode comprising a light emitting diode die and a packaging layer encapsulating the light emitting diode die.

5. The underwater lamp of claim 2, wherein a waterproof layer is positioned on the sink base and forms a water tight seal around the light generating element to keep water from flowing to the light generating element.

6. The underwater lamp of claim 5, further comprising a sealing ring positioned between the sink base and the waterproof layer.

7. The underwater lamp of claim 5, wherein the waterproof layer is made of one of glass, acrylic, and polycarbonate.

8. The underwater lamp of claim 1, further comprising a convergent lens positioned on the light generating element, and located on the optical path of the light generating element.

9. The underwater lamp of claim 1, further comprising a filter positioned in the at least one opening to prevent pollutants from flowing into the interior space.

10. The underwater lamp of claim 1, wherein the at least one opening comprises a pair of openings defined in opposite sides of the shell.

11. An underwater lamp, comprising:

a cylindrical shaped shell with two opposite ends being open;

a lens being arranged at one of the two opposite ends of the shell;

a sink base fixedly attached to the other one of the two opposite ends of the shell; wherein the shell, the sink base, and the lens cooperatively define an interior space;

a light generating element received in the interior space and fixedly attached to the sink base; and at least one opening being defined in the lamp for fluid flowing into the interior space.

12. The underwater lamp of claim 11, wherein the at least one opening is defined in one of the shell, the sink base, and the lens.

13. The underwater lamp of claim 11, further comprising a filter positioned in the at least one opening of the lamp to keep pollutants from flowing into the interior space.

14. The underwater lamp of claim 11, further comprising a convergent lens positioned on the light generating element and located on the optical path of the light generating element.

15. The underwater lamp of claim 11, further comprising a waterproof layer positioned on the sink base and a sealing ring being positioned between the waterproof layer and the sink base, wherein the waterproof layer, the sealing ring, and the sink base form a water tight seal around the light generating element to keep water from flowing to the light generating element.

16. The underwater lamp of claim 15, wherein the waterproof layer is made of one of glass, acrylic, and polycarbonate.

17. The underwater lamp of claim 11, further comprising a plurality of fins extending away from the sink base.

18. The underwater lamp of claim 11, wherein the light generating element comprises at least one light emitting diode.

19. The underwater lamp of claim 11, wherein the light generating element is a bulb or a cold cathode fluorescent lamp.

* * * * *